United States Patent [19]

Kreuter

[11] Patent Number: 4,855,545

[45] Date of Patent: Aug. 8, 1989

[54] PNEUMATIC TO ELECTRICAL SWITCH ASSEMBLY

[75] Inventor: Paul E. Kreuter, Thief River Falls, Minn.

[73] Assignee: Kreuter Mfg. Co., Inc., New Paris, Ind.

[21] Appl. No.: 261,230

[22] Filed: Oct. 24, 1988

[51] Int. Cl.[4] ..... H01H 35/34

[52] U.S. Cl. ..... 200/81.4; 200/83 S; 73/723

[58] Field of Search ..... 73/717, 723; 340/626; 307/118; 200/81.4, 83 R, 83 A, 83 B, 83 J, 83 S, 83 SA

[56] References Cited

U.S. PATENT DOCUMENTS

| | | | |
|---|---|---|---|
| 2,191,965 | 2/1940 | McGrath | 62/4 |
| 2,421,149 | 5/1947 | Segerstad | 200/81.4 |
| 2,551,526 | 5/1951 | Campbell | 73/147 |
| 2,766,349 | 10/1956 | Hamburg | 200/83 |
| 3,277,441 | 10/1966 | Gutjahr | 340/60 |
| 3,657,501 | 4/1972 | Hoyt | 200/81.4 |
| 3,786,210 | 1/1974 | Byam | 200/81.4 |
| 3,952,284 | 4/1976 | Martin | 340/71 |
| 3,985,985 | 10/1976 | Harwick | 200/81.4 |
| 4,163,964 | 8/1979 | De Filippis | 200/81.4 |
| 4,255,630 | 3/1981 | Hire et al. | 200/81.4 |
| 4,273,976 | 6/1981 | Wolford | 200/81.4 |
| 4,343,974 | 8/1982 | Hire et al. | 200/243 |
| 4,591,677 | 5/1986 | Hirota et al. | 200/83 |

*Primary Examiner*—Gerald P. Tolin
*Attorney, Agent, or Firm*—Kinney & Lange

[57] ABSTRACT

A multi-stage pressure-to-electric switch assembly includes a top casing provided with a pressure receiving chamber, a bottom casing integrally secured to the top casing in closing relation to the pressure receiving chamber, and a diaphragm clamped between the top casing and the bottom casing to be in sealing, closing relation to the pressure receiving chamber. This diaphragm is provided with three spaced-apart pressure response switch control portions, each portion including a switch control button. Three two-position electrical switches are fixedly supported with respect to the bottom casing. Three hollow, externally threaded switch control sleeves are aligned between the diaphragm control buttons and the switches. A switch operating control nut is threadably mounted on each of the switch control sleeves, and a switch operating plunger extends through each control sleeve between the diaphragm button and a switch. A coil spring seated on the switch operating pressure control nut exerts force against the diaphragm button. This force is adjusted by the positioning of the control nut on the control sleeve. When the pressure in the pressure receiving chamber exerts sufficient force on a particular diaphragm button, the strength of the spring is overcome, and its switch operates.

4 Claims, 3 Drawing Sheets

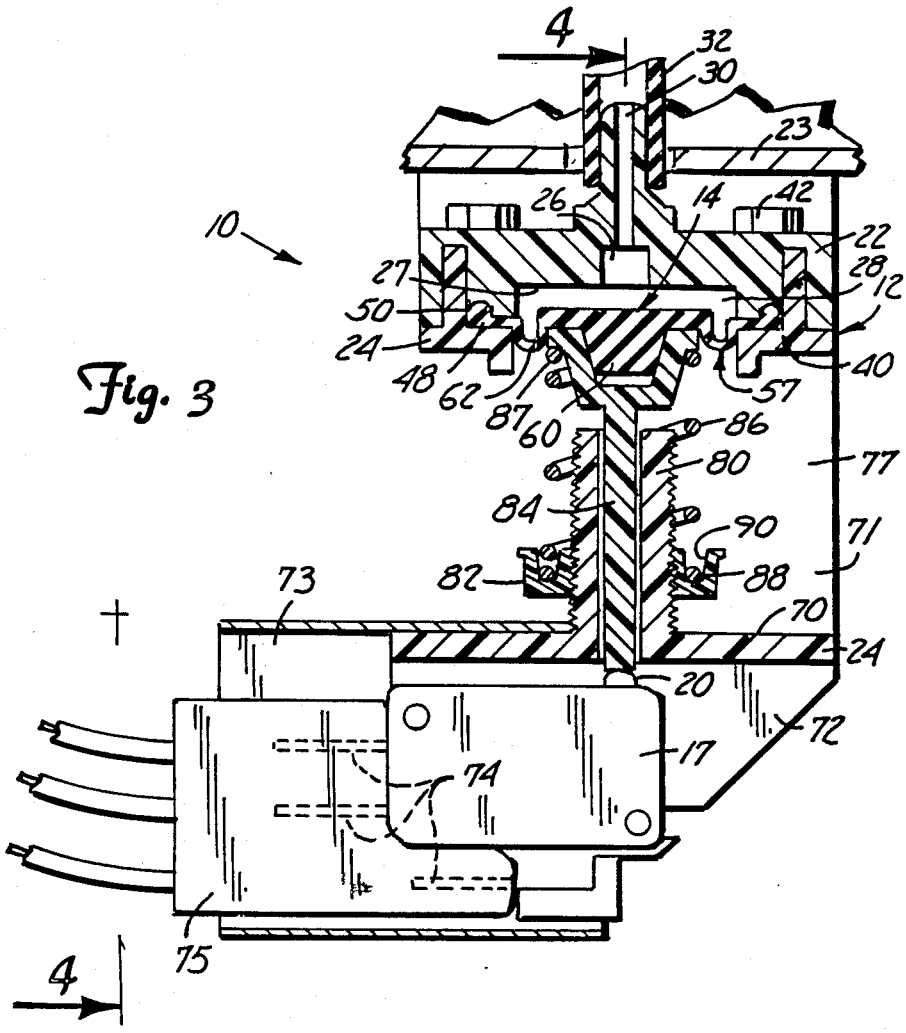
Fig. 3
Fig. 5
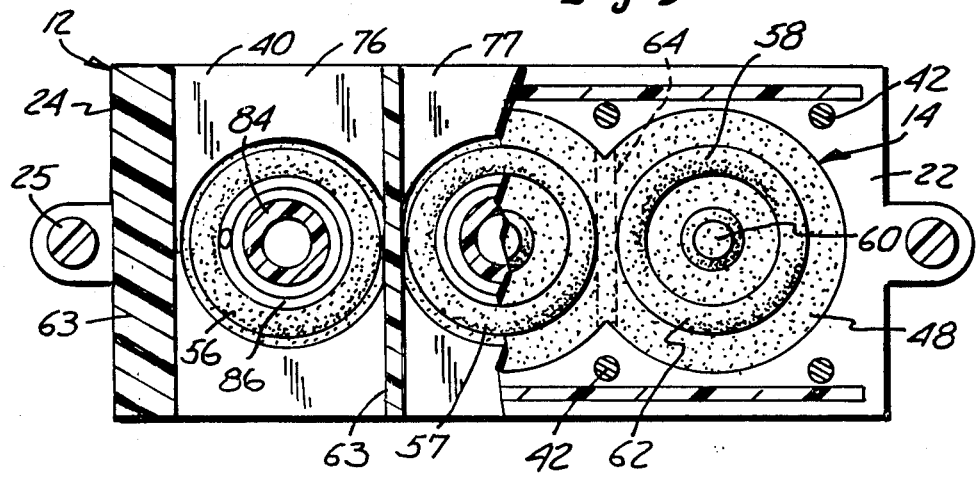

PNEUMATIC TO ELECTRICAL SWITCH ASSEMBLY

BACKGROUND OF THE INVENTION

1. Field of the Invention.

This invention relates to pressure-to-electrical switches and more particularly to the use of a single flexible diaphragm subjected to single source of varying control pressure to control by mechanical movement of the diaphragm, the operation of a plurality of electrical switches, each being actuated at its own adjustable pressure level.

2. Description of the Prior Art.

It is known to control electrical switches using pressure responsive diaphragms. Such teachings are found in the following U.S. patents: U.S. Pat. Nos. 4,273,976 granted to Wolford et al on June 16, 1981; 4,255,630 granted to Hire et al on March 10, 1981; 4,343,974 granted to Hire et al on Aug. 10, 1982; 2,766,349 granted to Hamburg on Oct. 9, 1956; 3,277,441 granted to Gutjahr on Oct. 4, 1966; 3,657,501 granted to Hoyt on April 18, 1972; and 4,591,677 granted to Hirota et al on May 27, 1986.

The patent to Wolford et al shows a single piece of rubber forming a diaphragm with a first set of magnets placed on the diaphragm in spaced relation with respect to each other. Different parts of the diaphragm are biased to resist diaphragm pressure by different amounts. Because of this differential, first magnets on the diaphragm act on aligned second magnets initially spaced from the diaphragm to activate separate switches under the force of different diaphragm pressures.

The patents to Hire et al each show one movable diaphragm portion simultaneously moving three or four electrical contacts.

In the patent to Hamburg, control pressure on a single portion of a single diaphragm controls first and second switches at two different pressure levels by using biasing springs of different strengths.

The patent to Gutjahr shows a single diaphragm portion operating a stepping switch whereby a number of switches in concentric relation to the movable diaphragm portion are opened serially upon application of an ever-increasing pressure against the diaphragm.

In the Hoyt patent, one area of a single diaphragm operates several pistons, the pistons successively operating as a series of stepping switches.

Lastly, the patent to Hirota et al shows a three-function switch including a single diaphragm having a single movable portion controlling the three switches by diaphragm movement along the single axes.

Other U.S. patents which are not believed to be particularly pertinent include U.S. Pat. Nos. 2,551,526 granted to Campbell on May 1, 1951; 2,421,149 granted to Segerstad on May 27, 1947; 3,952,284 granted to Martin on April 20, 1976; and 2,191,965 granted to McGrath on Feb. 27, 1940.

In the Campbell patent, a number of "limp" diaphragms are shown to lie in a single plane. A first side of each such limp diaphragm is fed the pressure developing along a different point in an airplane wing. The other side of each diaphragm is subjected to a constantly varying (sine wave) pressure. At the point the varying pressure on the second side of the diaphragm overcomes a particular predetermined pressure to be measured, a recording stylus relating to that diaphragm is lifted from a rotating chart.

The patent to Segerstad shows a single diaphragm situated to be controlled by a differential in pressure from two separate sources.

The Martin patent shows a single hydraulic tube open to three separate cylinders to move pistons in these cylinders to operate against three adjustable springs to that each piston can be sent to initially close its own electrical contact at its own preselected pressure.

Finally, the McGrath patent shows three pressure-to-electric switches controlled by three separate bellows fed by three different capillary tubes to operate separately under three separate conditions.

Means for serially putting electrically resistive heating elements "on the line" one after the other responsive to increases in pneumatic pressure is shown in the data sheets for Robertshaw Controls Company Model R450 Pneumatic Step Controller; and Johnson Controls G-180 Pneumatic Step Controller.

The Robertshaw controller includes a series of switches set to operate at different pressures. Each switch is operated by its own single diaphragm. This Robertshaw Model R450 has been in commerce for a considerable period of time before May 31, 1988.

The Johnsons Control Model G-180 Pneumatic Step Controller includes six, eight or twelve snap-acting single pole, double throw switches activated by individually adjustable "on" and "off" cams which are mounted on a common shaft which is rotated by a pneumatic actuator. This model has been in commerce since before Jan. 1, 1978.

The inventor and those in privity with him are aware of no prior art more pertinent than that discussed above. Neither he nor they are aware of any prior art which anticipates the present invention or the claims set out herein.

What was missing before the present invention was a pneumatic-to-electrical switch assembly in which a single diaphragm, which is subjected to a single source of varying control pressure on its first side, is provided with multiple pressure responsive switch control portions, each pressure responsive switch control portion being operative to activate its own electrical switch at a pressure on the diaphragm first side as determined by the setting of an easily adjustable, predetermined bias exerted on its switch control portion on a second side of the diaphragm.

SUMMARY OF THE INVENTION

An independently adjustable, multi-stage pressure-to-electric switch assembly (PE switch) includes a main frame having a top casing provided with a pressure receiving chamber having a diaphragm backup wall and having a pressure inlet port open from the pressure receiving chamber to a variable pressure source such as the output of a thermostatic device, for example. The main frame also has a bottom casing having a generally planar diaphragm clamping frame integrally secured to the top casing in closing relation to the pressure receiving chamber. The switch assembly or PE switch also includes a diaphragm clamped between the top casing and the bottom diaphragm casing clamping frame to be in sealing, closing relation to the pressure receiving chamber of the top casing, the diaphragm being provided with a plurality of spaced-apart mutually independent, pressure responsive switch control portions, each such portion including a switch control button surrounded by its own freely flexible diaphragm ring. Each switch control button is movable between an inoperative position in contact with the diaphragm backup wall of the top casing and an operative position spaced from the diaphragm backup wall. The top side of each switch control portion is at all times open to the pressure receiving chamber provided by the top casing.

The bottom casing of the main frame also includes a switch positioning shelf in spaced, generally parallel relation to the clamping frame, and includes shelf support wall means extending effectively at right angles between the clamping frame and the switch positioning shelf.

A plurality of two-position electrical switches are conditioned to nominally lie in a first of the two operative and inoperative positions. Each such switch is fixedly mounted with respect to the switch positioning shelf at a side of the shelf opposite the diaphragm, and each such switch has a switch operating element lying in operable alignment with respect to the switch control button of one of the diaphragm switch control portions.

A plurality of hollow switch control sleeves extend integrally upwardly from the switch positioning shelf, each sleeve being open through the shelf and each sleeve extending toward the diaphragm to lie in concentric, aligned relation between one of the switch control buttons and its operably aligned switch operating elements. Switch operating rods are positioned in operative contact with each diaphragm switch control button and each such rod extends into one of the switch control sleeves to lie in operational relationship with respect to one of the switch control elements.

A switch operating pressure control stop is adjustably mounted in spaced relationship with respect to the switch positioning shelf.

Resilient biasing means is operative between a first end in contact with the switch operating pressure control stop and a second end in contact with its associated diaphragm switch control button, each such biasing means being operative to exert a force between its switch operating stop and its diaphragm control button which force varies as a direct function of the distance between the first end of the biasing means and the switch operating element.

The length and positioning of each switch operating rod being such that, after the pressure in the pressure receiving chamber overcomes the pressure exerted by a particular biasing means, the movement of its associated diaphragm button from its inoperative to its operative position will cause the rod to make operative contact with respect to the switch control element to cause its associated two-position switch to move from its first position to its second position.

BRIEF DESCRIPTION OF THE DRAWINGS

FIG. 3 is an enlarged vertical sectional view taken on the line 3—3 in FIG. 1;

FIG. 5 is a horizontal sectional view taken on the line 5—5 in FIG. 4, showing one-half of a diaphragm of the invention and one-half of the bottom of a top casing of a main frame in plan, and showing one-half of the bottom of a diaphragm clamping frame of a bottom casing of the main frame of the invention in plan and in section.

DETAILED DESCRIPTION OF THE PREFERRED EMBODIMENTS

Figure 1:
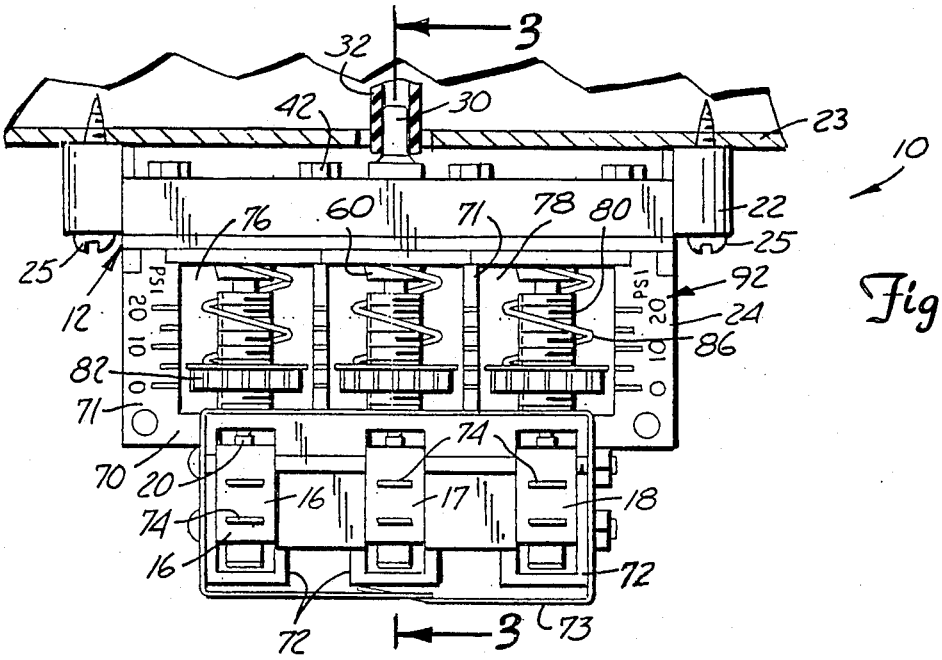
FIG. 1 is a front elevational view of a multi-stage pressure-to-electric switch made according to the present invention and shown mounted to a bulkhead in position for use.
Figure 2:
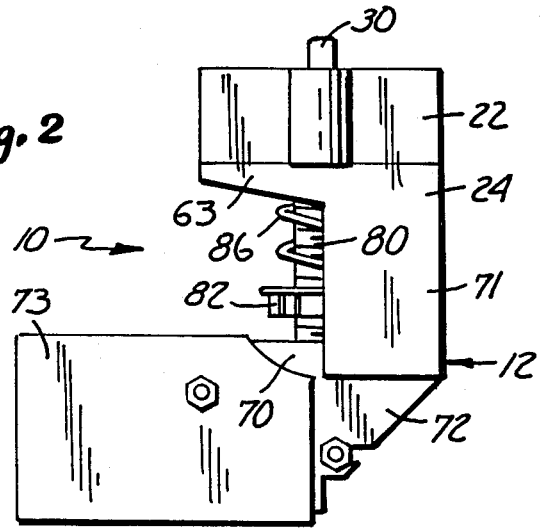
FIG. 2 is a side elevational view of the bulkhead of FIG. 1 as seen from the right in that figure.

An independently adjustable, multi-stage, pressure-to-electric switch assembly (PE switch) 10 includes a main frame 12, a rubber or rubber-like diagraphm 14, and three two-position electrical switches 16, 17 and 18, respectively, each such switch having a switch operating element 20 extending outwardly therefrom.

The PE switch 10 can operate in any position, but, to aid in understanding the invention, that portion of the switch assembly which is positioned at the top in FIGS. 1 through 4 is referred to throughout as the top of the switch assembly.

The main frame 12 of the PE switch 10 includes a top casing 22, and a bottom casing 24.

As shown, the top casing 22 is fastened to a bulkhead 23 by screws 25 and is provided with a pressure receiving chamber 26 and three diaphragm operating chambers 28, 28, and 28 each open to the pressure receiving chamber 26. These operating chambers 28 are partially defined by a diaphragm backup wall 27 of the top casing 22. A pressure inlet port or nipple 30 extends upwardly from the top casing 22 and is open through that casing wall to the pressure receiving chamber 26 and the diaphragm operating chambers 28.

As shown, an operating pressure tube 32 extends from a source of pressure (not shown) and delivers its pressure through the port 30 to the pressure receiving chamber 26.

A typical usage of the PE switch 10 of the invention is to control electric heating elements in response to pressures generated by thermostatic controls. As the pressure in the pressure tube 32 rises indicating a need for some heat, a first two-position electrical switch 16 will be activated sending heat to a first heating element. If this is not sufficient heat to satisfy the thermostat, the pressure will continue to rise and a second two-position electrical switch 17 will be activated putting a second heating element "on the line." Should the first two elements not be sufficient, the pressure in the tube 32 will continue to rise, and a third two-position electrical switch 18 will be activated, energizing a third heating element. These three heating elements are not shown and they and their circuitry can be of any usual or preferred construction.

The bottom casing 24 of the main frame 12 includes a generally planar diaphragm clamping frame 40. The top casing 22 and the diaphragm clamping frame 40 of the bottom casing 24 are integrally secured to each other through the instrumentality of machine bolts 42.

Figure 4:
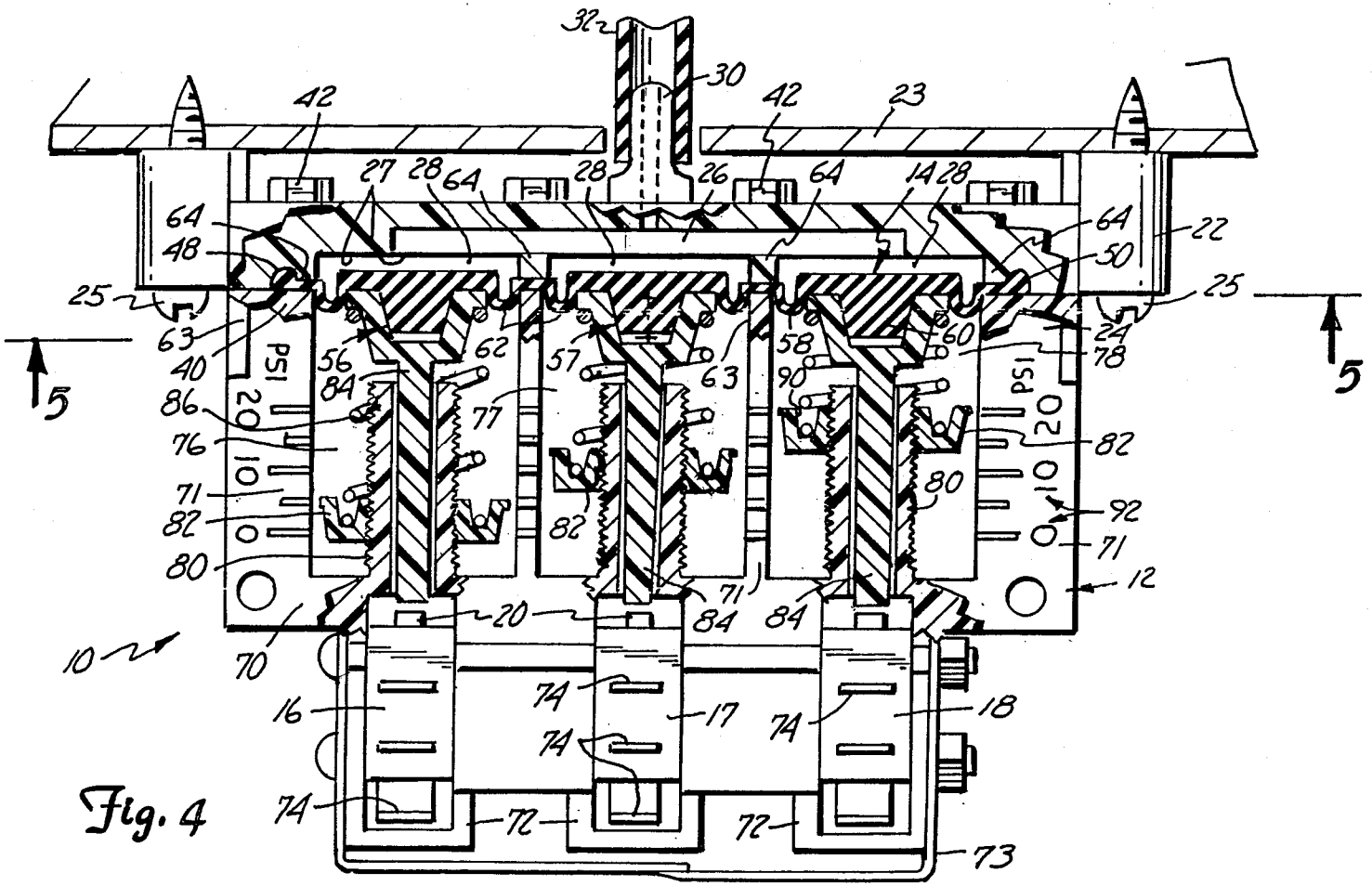
FIG. 4 is a vertical sectional view taken on the line 4—4 in FIG. 3.

The rubber or rubber-like diaphragm 14 is clamped between the top casing 22 and the clamping frame 40 of the bottom casing 24 to be in sealing, closing relation to the pressure receiving chamber 26 of the top casing. As best seen in FIGS. 3 and 4, diaphragm 14 is provided with an outer peripheral bead 48 which is firmly clamped in a provided groove 50 in the top casing 22.

Diaphragm 14 includes three pressure responsive switch control portions 56, 57 and 58, each operationally associated with and aligned with one of the two-position electrical switches 16, 17 and 18, respectively. At each such position, the diaphragm includes a relatively rigid switch control button 60; and each such button 60 is connected to the rest of the diaphragm by a freely flexible diaphragm ring 62.

As best seen in FIGS. 4 and 5, each of the diaphragm switch control portions 56, 57 and 58 is isolated from the others by walls 64 which extend downwardly from the underside of the top casing 22 into contact with the diaphragm 14. Walls 63, forming part of the diaphragm clamping frame 40 of the bottom casing 24 of the main frame 12, align with walls 64 on the underside of the diaphragm to complete this isolation.

The bottom casing 24 of the main frame 12 includes a switch positioning shelf 70 in substantially spaced, generally parallel relation to its diaphragm clamping frame 40. This shelf 70 is connected to the clamping frame 40 by four shelf support walls 71, each of which extends downwardly from clamping frame 40 at right angles to the shelf 70 as an extension of the rear half of one of the walls 63. Walls 71 act as partial partitions between three independent switch pressure control zones 76, 77 and 78, each aligned with a pressure responsive switch control portion 56, 57 or 58 of the diaphragm and a two-position electrical switch 16, 17 or 18, respectively.

Three pairs of switch support walls 72 extend downwardly from switch positioning shelf 70, each set supporting a switch 16, 17 or 18. An insulating, protective, fiberous sheath 73 extends around these switches and portions of walls 72.

Each two position switch 16, 17 and 18 is provided with three male electrical contacts 74 as seen in FIGS. 1 and 4; and, as indicated in FIG. 3, a female plug 75 can be assembled to each switch to attach it to wires needed to activate electrical heating elements or to accomplish other purposes as desired.

A plurality of rod means in the form of three hollow, externally threaded, switch control sleeves 80 extend integrally upwardly from the positioning shelf 70, each is open through that shelf, and each is in concentric alignment between one of the switch control buttons 60 of the diaphragm pressure responsive switch control portions 56, 57 or 58 and the switch operating element 20 of one of the two-position electrical switches 16, 17 or 18, respectively.

A switch operating stop or operating pressure control or nut 82 is threadably mounted on each switch control sleeve 80. A switch operating means or plunger 84 is in operative contact with each of the diaphragm switch control buttons 60 and extends into one of the switch control sleeves 80 to lie in adjacent relation to a switch control element 20 of one of the two-position electrical switches 16, 17 or 18. Resilient biasing means such as three compression coil springs 86 each has a first end 87 thereof in contact with one of the diaphragm control buttons 60. A second end 88 of each compression coil spring 86 is in contact with one of the switch operating pressure control nuts 82, and lies in a spring receiving groove 90 provided in each nut 82. As seen in FIG. 1 and as most clearly seen in FIG. 4, each of the four bottom casing shelf support walls 71 is provided with indicia 92 indicating pressures from 0 to 20 pounds per square inch (psi).

The pressure setting of the switch operating pressure control nuts 82 as shown in FIG. 4 indicates a tensioning of the springs 86 to cause switch 16 to operate at 5 psi, switch 17 to operate at about 13 psi, and switch 18 to operate at 20 psi. For the purpose of clarity of illustration, however, the diaphragm switch control buttons 60 in FIGS. 3 and 4 are shown as if there was no pressure whatever being exerted by springs 86.

With the switch operating pressure control nuts 82 set as seen in FIG. 4 and with no pressure applied through the inlet port 30, each of the diaphragm switch control buttons 60 would be resting flat against the diaphragm backup wall 27 provided by the top casing 22.

OPERATION

With the switch operating pressure control nuts 82 positioned as seen in FIG. 4, until the pressure in the operating pressure tube 32 reaches 5 psi, and brings the pressure in the pressure receiving chamber 26 and the diaphragm operating chambers 28 to that pressure, there would be no movement of any of the plungers 84 and no operation of any of the two-position electrical switches. When 5 psi is achieved, downward pressure on diaphragm button 60 of a first switch control portion 56 will overcome the strength of its compression coil spring 86 in a first of the switch pressure control zones 76, and the plunger in that zone will move to contact switch operating element 20 of two-position electrical switch 16 to move that switch from its first position to its second position.

When the pressure in the pressure receiving chamber 26 reaches 13 psi, the force of the spring 86 in second independent switch pressure control portion 77 will be overcome, and diaphragm switch control button 60 of a second switch control portion 57 of diaphragm 14 will cause its aligned plunger 84 to move switch operating element 20 of switch 17 to its second position.

When the pressure in the chamber 26 reaches 20 psi, the force exerted by spring 86 in third independent switch pressure control portion 78 will be overcome by the force of the switch control button 60 of a third switch control portion 58, and two-position electrical switch 18 will be moved to its second position.

As the pressure in chamber 26 decreases, the downward force exerted by all of the diaphragm switch control buttons 60 will decrease uniformly, and as the biasing force of each spring 86 overcomes the pressure exerted on its switch control button, its associated two-position electrical switch will move from its second to its first position.

Although the present invention has been described with reference to preferred embodiments, workers skilled in the art will recognize that changes may be made in form and detail without departing from the spirit and scope of the invention.

What is claimed is:

1. A multi-stage pressure-to-electric switch assembly having independently adjustable stages, said switch assembly including:

(a) a main frame having:

(1) a top casing provided with a pressure receiving chamber having a diaphragm backup wall and having a pressure inlet port open from the pressure receiving chamber to a variable pressure source, and (2) a bottom casing having a generally planar diaphragm clamping frame integrally secured to the top casing in closing relation to the pressure receiving chamber;

(b) a diaphragm clamped between the top casing and the bottom diaphragm casing clamping frame to be in sealing, closing relation to the pressure receiving chamber of the top casing, said diaphragm being provided with a plurality of spaced-apart, mutually independent, pressure responsive switch control portions, each such portion including a relatively rigid switch control button surrounded by its own freely flexible diaphragm ring, each button being movable between an inoperative position in contact with the diaphragm backup wall of the top casing and an operative position spaced from said diaphragm backup wall, and the top side of each switch control portion being at all times open to said pressure receiving chamber;

(c) said bottom casing also including a switch positioning station supported in spaced, generally parallel relation to the clamping frame;

(d) a plurality of two-position electrical switches conditioned to nominally lie in a first of said two positions, each switch being fixedly supported with respect to the switch positioning station in spaced relation with respect to the bottom casing diaphragm clamping frame, and each switch having a switch operating element lying in operable alignment with respect to the switch control button of one of the diaphragm switch control portions;

(e) a plurality of fixed switch control rod means extending upwardly from the switch positioning station, each switch control rod means extending toward said diaphragm to lie in aligned relation between one of the switch control buttons and its operably aligned switch operating elements;

(f) a switch operating pressure control stop adjustably mounted with respect to each switch control rod means;

(g) switch operating means in operative contact with each diaphragm switch control button and extending in parallel relation to one of the switch control rod means to lie in operable relationship with respect to one of the switch control elements;

(h) resilient biasing means having a first end in operational contact with one of the switch operating pressure control operating stops and a second end in operational contact with one of the aligned diaphragm switch control buttons and a second end in operational contact with its aligned switch operating pressure control operating stops, each biasing means being operative to exert a force between its operating stop and its switch control button which force varies as a direct function of the distance between the second end of the biasing means and the switch operating element; and (i) the length and positioning of each switch operating means being such that, after the pressure in the pressure receiving chamber overcomes the pressure exerted by the biasing means, the movement of its diaphragm button from its inoperative to its operative position will cause the switch operating means to contact the switch control element to cause the two-position switch to move from its first position to its second position.

2. A multi-stage pressure-to-electric switch assembly having independently adjustable stages, said switch assembly including:

(a) a main frame having:

(1) a top casing provided with a pressure receiving chamber which is partially defined by a diaphragm backup wall and a generally planar diaphragm clamping surface, the top casing also being provided with a pressure inlet port open from the pressure receiving chamber to a variable pressure source, and (2) a bottom casing having a generally planar diaphragm clamping frame integrally secured to the clamping surface of the top casing in closing relation to the pressure receiving chamber;

(b) a diaphragm clamped between the clamping surface of top casing and the bottom diaphragm casing clamping frame to be in sealing, closing relation to the pressure receiving chamber of the top casing, said diaphragm being provided with a plurality of spaced-apart, mutually independent, pressure responsive switch control portions, each such portion including a switch control button surrounded by its own freely flexible diaphragm ring, each button being movable between an inoperative position supported against the diaphragm backup wall of the top casing an operative position spaced from said diaphragm backup wall, and the top side of each switch control portion being at all times open to said pressure receiving chamber;

(c) said bottom casing also including a switch positioning shelf in spaced, generally parallel relation to its clamping frame, and a plurality of shelf support walls extending effectively at right angles between its clamping frame and its switch positioning shelf;

(d) a plurality of two-position electrical switches conditioned to nominally lie in a first of said two positions, each switch being fixedly mounted with respect to the switch positioning shelf at a side of the shelf opposite the diaphragm, and each switch having a switch operating element lying in operable alignment with respect to the switch control button of one of said diaphragm switch control portions;

(e) a plurality of hollow, externally threaded, switch control sleeves extending integrally upwardly from said switch positioning shelf, each sleeve being open through the shelf and each sleeve extending toward said diaphragm to lie in concentric, aligned relation between one of the switch control buttons and its operably aligned switch operating elements;

(f) a switch operating pressure control nut threadably mounted on each switch control sleeve;

(g) a switch operating plunger having a first end portion in operative contact with each diaphragm switch control button, an intermediate portion extending into and through one of the switch control sleeves and having a second end portion situated in operable relationship with respect to one of the switch control elements;

(h) a compression coil spring in surrounding relation to each switch operating plunger and switch control sleeve, each spring having a first end in operational contact with its aligned diaphragm switch control button and the first end portion of the switch operating plunger, and having a second end in contact with its aligned operating pressure control nut, each spring being operative to exert a force between its control nut and its diaphragm switch control button which force varies as a direct function of the distance between the second end of the spring and the switch operating element; and (i) the length and positioning of each switch operating plunger being such that, after the pressure in the pressure receiving chamber overcomes the pressure exerted by its associated compression coil spring, the movement of its diaphragm button from its inoperative to its operative position will cause the plunger to contact the switch control element to cause the two-position switch to move from its first position to its second position.

3. The switch assembly of claim 2 wherein:

(j) there are at least three two-position electrical switches and the diaphragm includes at least three switch control portions.

4. A pressure to mechanical transducer assembly, said assembly including:

(a) a main frame having:

(1) a top casing provided with a pressure receiving chamber having a diaphragm backup wall and having a inlet port open from the pressure receiving chamber to a variable pressure source, and (2) a bottom casing having a generally planar diaphragm clamping frame integrally secured to the top casing in closing relation to the pressure receiving chamber;

(b) a diaphragm clamping between the top casing and the bottom diaphragm casing clamping frame to be in sealing, closing relation to the pressure receiving chamber of the top casing, said diaphragm being provided with a plurality of spaced-apart, mutually independent, pressure responsive switch control portions, each such portion including a relatively rigid switch control button surrounded by its own freely flexible diaphragm ring, each button being movable between an inoperative position in contact with the diaphragm backup wall of the top casing and an operative position spaced from said diaphragm backup wall, and the top side of each switch control portion being at all times open to said pressure receiving chamber;

(c) said bottom casing also including a positioning shelf in spaced, generally parallel relation to the clamping frame through the instrumentality of shelf support wall means extending between the clamping frame and the positioning shelf;

(d) a plurality of externally threaded switch control rods extending integrally upwardly from said positioning shelf, each rod extending toward said diaphragm to lie in concentric, aligned relation with one of the diaphragm control buttons;

(e) an operating pressure control nut threadably mounted on each control rod;

(f) separate mechanical motion detecting means in operational contact with each diaphragm control button;

(g) a compression coil spring in surrounding relation to each control rod, the spring having a first end in operational contact with its aligned diaphragm control button and a second end in operational contact with its aligned operating pressure control nut, each spring being operative to exert a force between its control nut and its diaphragm control button which force varies as a direct function of the distance between the second end of the spring and the positioning shelf; and (h) the nature and character of each of the mechanical motion detection means being such that, after the pressure in the pressure receiving chamber overcomes the pressure exerted by its compression coil spring, the movement of the diaphragm button from its inoperative to its operative position will cause the mechanical motion detection means to perform movement proportional to the movement of its diaphragm button.

* * * * *

UNITED STATES PATENT AND TRADEMARK OFFICE

CERTIFICATE OF CORRECTION

PATENT NO. : 4,855,545

DATED : August 8, 1989

INVENTOR(S) : Paul E. Kreuter

It is certified that error appears in the above-identified patent and that said Letters Patent is hereby corrected as shown below:

On the title page:

Under OTHER PUBLICATIONS, insert:

Data Sheets for Robertshaw Controls Company Model R450 Pneumatic Step Controller Data Sheets for Johnson Controls G-180 Pneumatic Step Controller Column 8, line 16, after "casing" insert therefore --and--.

Column 9, line 20, delete "clamping" and insert therefore --clamped--.

Signed and Sealed this

Third Day of July, 1990

*Attest:*

*Attesting Officer*

HARRY F. MANBECK, JR.

*Commissioner of Patents and Trademarks*